US010996603B2

(12) United States Patent
Uchida et al.

(10) Patent No.: US 10,996,603 B2
(45) Date of Patent: May 4, 2021

(54) IMAGE FORMING APPARATUS

(71) Applicant: Brother Kogyo Kabushiki Kaisha, Nagoya (JP)

(72) Inventors: Mariko Uchida, Nagoya (JP); Tetsuya Morita, Nagoya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 264 days.

(21) Appl. No.: 16/273,489

(22) Filed: Feb. 12, 2019

(65) Prior Publication Data

US 2019/0250545 A1 Aug. 15, 2019

(30) Foreign Application Priority Data

Feb. 13, 2018 (JP) ..... JP2018-023117

(51) Int. Cl.
*G03G 15/23* (2006.01)
*B65H 85/00* (2006.01)
*G03G 15/00* (2006.01)

(52) U.S. Cl.
CPC ..... *G03G 15/234* (2013.01); *B65H 85/00* (2013.01); *G03G 15/50* (2013.01); *G03G 15/6529* (2013.01); *B65H 2301/33312* (2013.01)

(58) Field of Classification Search
CPC ..... G03G 15/234
USPC ..... 399/401
See application file for complete search history.

(56) References Cited

U.S. PATENT DOCUMENTS 9,897,961 B2 2/2018 Watanabe
2011/0236096 A1* 9/2011 Miwa ..... G03G 15/234 399/364
2013/0187330 A1* 7/2013 Kuroda ..... B41J 3/60 271/225
2013/0214479 A1* 8/2013 Dobrindt ..... B65H 5/062 271/225
2014/0092448 A1* 4/2014 Tsai ..... H04N 1/121 358/498
2014/0123796 A1* 5/2014 Ishida ..... G03G 15/00 74/421 A
2014/0244282 A1* 8/2014 White ..... G16H 40/20 705/2

(Continued)

FOREIGN PATENT DOCUMENTS

JP 2000-075581 A 3/2000
JP 2016-210121 A 12/2016

*Primary Examiner* — Anthony H Nguyen
(74) *Attorney, Agent, or Firm* — Banner & Witcoff, Ltd.

(57) ABSTRACT

An image forming apparatus includes an image forming unit and a re-conveyor. The re-conveyor includes a first bevel gear, a second bevel gear, a first re-conveying roller, a shaft member, a first engaged member, a second engaged member, and an engaging member. When the second bevel gear is rotated in a rotational direction by a driving force transmitted from the first bevel gear, the engaging member is moved to a second position and engaged with the first and second engaged members to rotate the shaft member in a rotational direction. When the shaft member is rotated in the rotational direction by a driving force transmitted from the first re-conveying roller, the engaging member is moved to a first position, disengaged from the second engaged member, and engaged with the first engaged member to interrupt transmission of the driving force from the shaft member to the second bevel gear.

10 Claims, 12 Drawing Sheets

(56) References Cited

U.S. PATENT DOCUMENTS

2016/0334746 A1 11/2016 Watanabe
2018/0307174 A1* 10/2018 Hayayumi ..... B65H 1/266

* cited by examiner

IMAGE FORMING APPARATUS

CROSS REFERENCE TO RELATED APPLICATION

The present application claims priority from Japanese Patent Application No. 2018-023117, which was filed on Feb. 13, 2019, the disclosure of which is herein incorporated by reference in its entirety.

BACKGROUND

The following disclosure relates to an image forming apparatus configured to form images respectively on opposite surfaces of the sheet.

There are conventionally known image forming apparatuses configured to form images respectively on opposite surfaces of the sheet. Such image forming apparatuses include a re-conveyor configured to convey a sheet with an image formed on its one side, to an image forming unit again. One example of the image forming apparatuses includes a re-conveyor having re-conveying rollers configured to convey the sheet to the image forming unit again.

In the image forming apparatus, when the sheet being conveyed by the re-conveying rollers has reached registration rollers, and is conveyed by the registration rollers, transmission of a driving force to the re-conveying rollers is interrupted to stop driving the re-conveying rollers, thereby reducing noise caused by driving of the re-conveying rollers.

In this case, at the point in time when the registration rollers start conveying a leading edge portion of the sheet conveyed again, the sheet is still nipped between the re-conveying rollers, and the re-conveying rollers are being rotated by the sheet conveyed by the registration rollers.

SUMMARY

In the case where the re-conveying rollers are rotated by the sheet being conveyed by the registration rollers as described above, a heavy load acting on the re-conveying rollers in some cases inhibits the rotation of the re-conveying rollers rotated by the sheet. This may cause a slip between the sheet and the re-conveying rollers, leading to partial wear on the re-conveying rollers and lowered accuracy of conveyance of the sheet.

Accordingly, an aspect of the disclosure relates to an image forming apparatus capable of reducing lowering of the accuracy of conveyance of a sheet.

In one aspect of the disclosure, an image forming apparatus includes: an image forming unit configured to form an image on a sheet; and a re-conveyor configured to re-convey the sheet on which an image is formed toward the image forming unit in a re-conveying direction. The re-conveyor includes: a first bevel gear configured to receive a driving force transmitted from a drive source; a second bevel gear engaged with the first bevel gear and configured to be rotated about an axis extending in a first direction; a first re-conveying roller configured to convey the sheet in the re-conveying direction; a shaft member configured to transmit the driving force transmitted from the second bevel gear, to the first re-conveying roller; a first engaged member provided at one end of the second bevel gear in the first direction, which one end is nearer to the shaft member than the other end of the second bevel gear in the first direction, the first engaged member being configured to be rotated together with the second bevel gear; a second engaged member provided at the other end of the shaft member in the first direction, which other end is nearer to the second bevel gear than one end of the shaft member in the first direction, the second engaged member being configured to be rotated together with the shaft member; and an engaging member disposed between the first engaged member and the second engaged member and movable between a first position at which the engaging member is engaged only with the first engaged member and a second position at which the engaging member is engaged with the first engaged member and the second engaged member. The engaging member is configured to: when the second bevel gear is rotated in a rotational direction by the driving force transmitted from the first bevel gear, be moved to the second position and engaged with the first engaged member and the second engaged member to rotate the shaft member in the rotational direction; and when the shaft member is rotated in the rotational direction by the driving force transmitted from the first re-conveying roller, be moved to the first position, disengaged from the second engaged member, and engaged with the first engaged member to interrupt transmission of the driving force from the shaft member to the second bevel gear.

In one aspect of the disclosure, an image forming apparatus includes: an image forming unit configured to form an image on a sheet; and a re-conveyor configured to re-convey the sheet on which an image is formed toward the image forming unit in a re-conveying direction. The re-conveyor includes: a first bevel gear configured to receive a driving force transmitted from a drive source; a second bevel gear engaged with the first bevel gear and configured to be rotated about an axis extending in a first direction; a first re-conveying roller configured to convey the sheet in the re-conveying direction; a shaft member that is a portion of a transmission mechanism configured to transmit the driving force from the second bevel gear to the first re-conveying roller; a first engaged member provided at one of opposite end portions of the second bevel gear, which one is nearer to the shaft member in the first direction than the other, and the first engaged member is configured to be rotated about the axis together with the second bevel gear; a second engaged member provided at one of opposite end portions of the shaft member, which one is nearer to the second bevel gear in the first direction than the other, the second engaged member being configured to be rotated about the axis together with the shaft member; and an engaging member disposed between the first engaged member and the second engaged member and including a first engaging portion and a second engaging portion, the first engaging portion being an end portion of the engaging member which is nearer to the first engaged member in the first direction than the second engaging portion, the second engaging portion being an end portion of the engaging member which is nearer to the second engaged portion in the first direction than the first engaging portion, the engaging member being movable in the first direction between a first position at which the first engaging portion is engaged with the first engaged member, and the second engaging portion is not engaged with the second engaged portion and a second position at which the first engaging portion is engaged with the first engaged member, and the second engaging portion is engaged with the second engaged member. At least one of the first engaged member and the engaging member includes a first converting inclined portion configured to convert rotational power of the first engaged member about the axis, to a force that is applied from the first engaged member to the engaging member and that is directed from the first position toward the second position. At least one of the second engaged member and the engaging member includes a second converting inclined portion configured to convert rotational power of the second engaged member about the axis, to a force that is applied from the second engaged portion to the engaging member and that is directed from the second position toward the first position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Overall Configuration of Image Forming Apparatus

Figure 1:
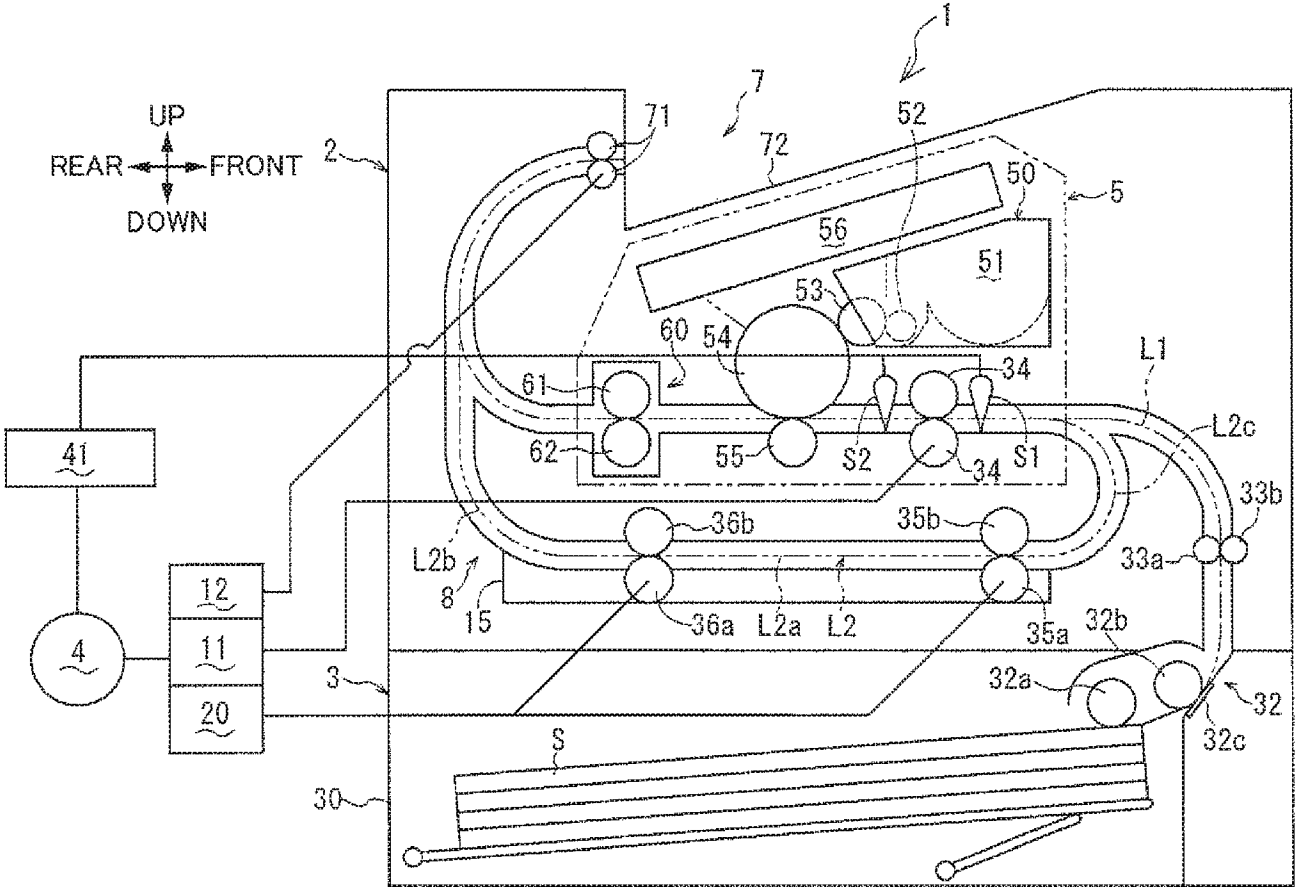
FIG. 1 is a cross-sectional view of an image forming apparatus, taken along its central line.
Figure 2:
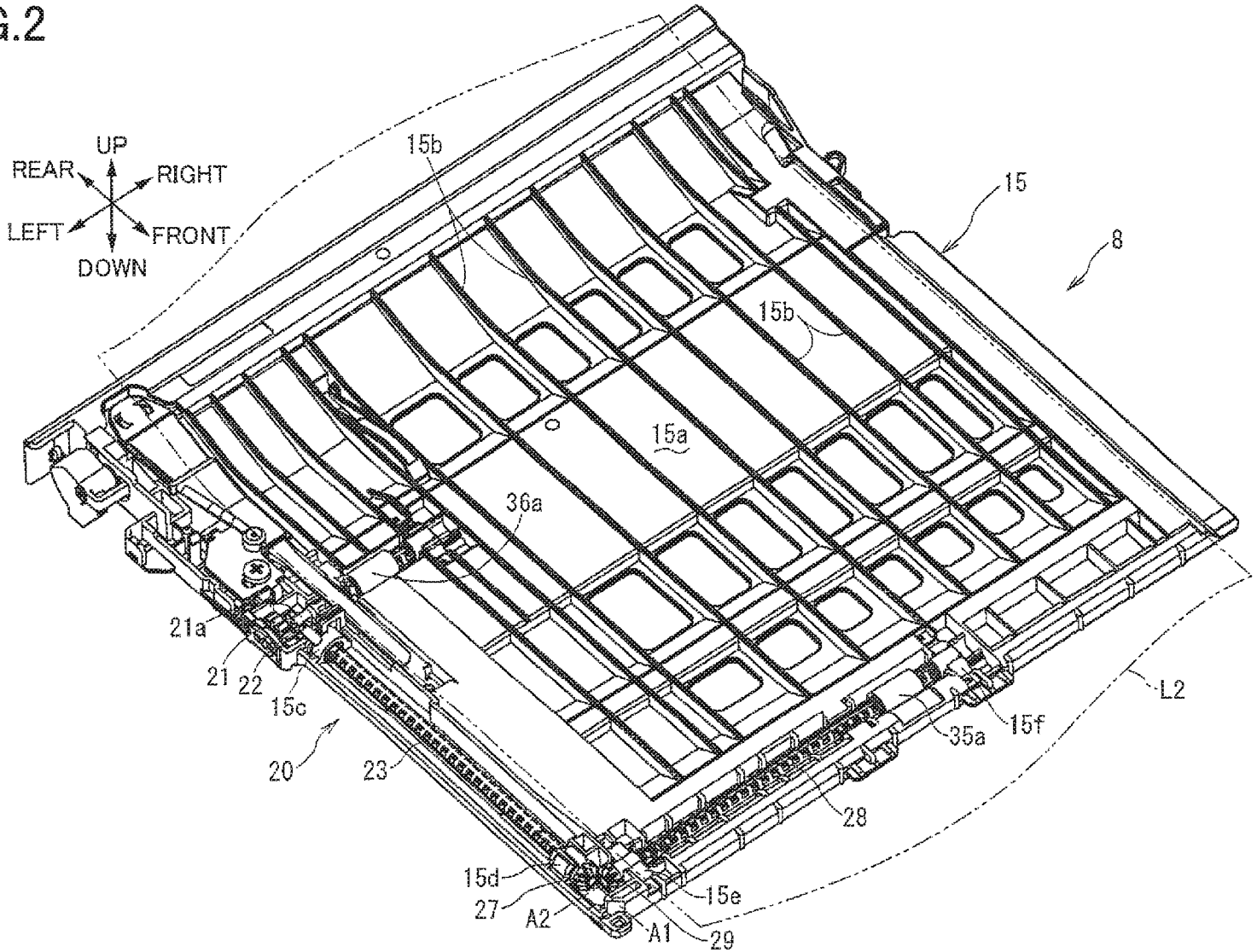
FIG. 2 is a perspective view of a re-conveyor.

An image forming apparatus 1 illustrated in FIG. 1 is an image forming apparatus according to one embodiment. The image forming apparatus 1 includes a housing 2, a sheet supplier 3, an image forming unit 5, a discharger 7, a re-conveyor 8, and a motor 4 as one example of a drive source.

In the following description, the right side in FIG. 1 is defined as a front side of the image forming apparatus 1, the left side in FIG. 1 as a rear side of the image forming apparatus 1, the front side of the sheet of FIG. 1 as a left side of the image forming apparatus 1, the back side of the sheet of FIG. 1 as a right side of the image forming apparatus 1, and the upper and lower sides in FIG. 1 respectively as upper and lower sides of the image forming apparatus 1.

The housing 2 houses the sheet supplier 3, the image forming unit 5, the discharger 7, the re-conveyor 8, and the motor 4. The sheet supplier 3 is disposed at a lower portion of the housing 2 and configured to convey each of sheets S supported by a sheet cassette 30, to the image forming unit 5. The image forming unit 5 is disposed downstream of the sheet supplier 3 in a direction in which the sheet S is conveyed (hereinafter may be referred to as "sheet conveying direction"). The image forming unit 5 forms an image on the sheet S supplied by the sheet supplier 3. The discharger 7 is disposed downstream of the image forming unit 5 in the sheet conveying direction and configured to discharge the sheet S with an image formed by the image forming unit 5, to the outside of the image forming apparatus 1 or convey the sheet S toward the image forming unit 5 again.

The sheet supplier 3 includes: the sheet cassette 30 for supporting the sheet S; a sheet-supply mechanism 32; conveying rollers 33*a*, 33*b*; and registering rollers 34 constituting a conveyor configured to convey the sheet S along a conveyance path L1. The image forming apparatus 1 has the conveyance path L1 extending from the sheet supplier 3 to the discharger 7 via the image forming unit 5.

The sheet-supply mechanism 32 includes a sheet-supply roller 32*a*, a separating roller 32*b*, and a separating pad 32*c*. The sheet-supply roller 32*a* supplies the sheets S supported by the sheet cassette 30, toward the separating roller 32*b*. The separating roller 32*b* is disposed downstream of the sheet-supply roller 32*a* in the sheet conveying direction. The separating pad 32*c* is opposed to the separating roller 32*b* and urged toward the separating roller 32*b*.

The sheets S supplied by the sheet-supply roller 32*a* toward the separating roller 32*b* are separated one by one between the separating roller 32*b* and the separating pad 32*c*. The separated sheet S is conveyed toward the conveying rollers 33*a*, 33*b* along the conveyance path L1.

The conveying rollers 33*a*, 33*b* are configured to convey the sheet S and disposed downstream of the sheet-supply mechanism 32 in the sheet conveying direction. The sheet S supplied from the sheet-supply mechanism 32 toward the conveying rollers 33*a*, 33*b* is conveyed by the conveying rollers 33*a*, 33*b* toward the registering rollers 34 along the conveyance path L1.

The registering rollers 34 are disposed downstream of the conveying rollers 33*a*, 33*b* in the sheet conveying direction. The registering rollers 34 temporarily stop movement of a leading edge of the conveyed sheet S to correct a position of the sheet S. The registering rollers 34 then convey the sheet S toward a transfer position of the image forming unit 5 at a predetermined timing.

A pre-registering sensor S1 is disposed upstream of the registering rollers 34 in the sheet conveying direction. A post-registering sensor S2 is disposed downstream of the registering rollers 34 in the sheet conveying direction.

The pre-registering sensor S1 and the post-registering sensor S2 detect the sheet S. When the leading edge of the sheet S conveyed along the conveyance path L1 in the sheet conveying direction has reached a position corresponding to each of the pre-registering sensor S1 and the post-registering sensor S2, a corresponding one of the pre-registering sensor S1 and the post-registering sensor S2 is turned to ON to detect the sheet S. When the trailing edge of the sheet S conveyed along the conveyance path L1 in the sheet conveying direction has reached the position corresponding to each of the pre-registering sensor S1 and the post-registering sensor S2, a corresponding one of the pre-registering sensor S1 and the post-registering sensor S2 is turned to OFF to cease detecting the sheet S.

The registering rollers 34 start rotating after the elapse of a particular length of time from the timing when the leading edge of the sheet S conveyed along the conveyance path L1 in the sheet conveying direction reaches the position corresponding to the pre-registering sensor S1, and the pre-registering sensor S1 is turned to ON. The registering rollers 34 stop rotating after the elapse of a particular length of time from the timing when the trailing edge of the sheet S in the sheet conveying direction reaches the position corresponding to the post-registering sensor S2, and the post-registering sensor S2 is turned to OFF.

The image forming unit 5 includes: a process cartridge 50 configured to transfer an image onto a surface of the sheet S conveyed from the sheet supplier 3; an exposing unit 56 configured to expose a surface of a photoconductor drum 54 in the process cartridge 50; and a fixing unit 60 configured to fix the image transferred to the sheet S by the process cartridge 50.

The process cartridge 50 is disposed above the sheet supplier 3 in the housing 2. The process cartridge 50 includes a developer containing chamber 51, a supply roller 52, a developing roller 53, the photoconductor drum 54, and a transfer roller 55.

The exposing unit 56 includes a laser diode, a polygon mirror, lenses, and a reflective mirror. The exposing unit 56 exposes the surface of the photoconductor drum 54 by emitting laser light toward the photoconductor drum 54 based on image data input to the image forming apparatus 1.

The developer containing chamber 51 contains toner as a developer. The toner contained in the developer containing chamber 51 is supplied to the supply roller 52 while being agitated by an agitator, not illustrated. The toner supplied from the developer containing chamber 51 is further supplied to the developing roller 53 by the supply roller 52.

The developing roller 53 is disposed in close contact with the supply roller 52 and configured to bear the toner supplied from the supply roller 52 and positively charged by a slider, not illustrated. Also, a positive developing bias is applied to the developing roller 53 by a bias applier, not illustrated.

The photoconductor drum 54 is disposed next to the developing roller 53. The surface of the photoconductor drum 54 is positively charged uniformly by a charging unit, not illustrated, and then exposed by the exposing unit 56. Areas of the photoconductor drum 54 that are exposed to light are lower in electric potential than the other area of the photoconductor drum 54, so that an electrostatic latent image is formed on the photoconductor drum 54 based on the image data. The positively charged toner is supplied from the developing roller 53 to the surface of the photoconductor drum 54 with the electrostatic latent image formed thereon, whereby the electrostatic latent image is made visible to form a developed image.

The transfer roller 55 is opposed to the photoconductor drum 54, and a negative transfer bias is applied to the transfer roller 55 by the bias applier, not illustrated. At the transfer position, the sheet S is nipped between and conveyed by the photoconductor drum 54 with the developed image formed thereon and the transfer roller 55 with the transfer bias on the surface of the transfer roller 55. As a result, the developed image formed on the surface of the photoconductor drum 54 is transferred to the surface of the sheet S.

The fixing unit 60 includes a heat roller 61 and a pressure roller 62. The heat roller 61 is rotated by a driving force supplied from the motor 4 and is heated by electric power supplied from a power source unit, not illustrated. The pressure roller 62 is opposed to the heat roller 61 and rotated by the heat roller 61 in close contact therewith. When the sheet S on which the developed image is transferred is conveyed to the fixing unit 60 along the conveyance path L1, the sheet S is nipped and conveyed by the heat roller 61 and the pressure roller 62 to fix the developed image to the sheet S.

The discharger 7 includes a pair of switch-back rollers 71 and an output tray 72 for supporting the sheet S discharged to the outside of the housing 2. The switch-back rollers 71 are capable of discharging the sheet S conveyed from the fixing unit 60 along the conveyance path L1, toward the outside of the housing 2. The output tray 72 is formed on an upper surface of the housing 2 to support the sheet S discharged by the switch-back rollers 71 to the outside of the housing 2.

The switch-back rollers 71 are rotatable in a rotational direction for conveying the sheet S toward the output tray 72. This rotational direction may be hereinafter referred to as "discharging direction". The switch-back rollers 71 are also rotatable in a rotational direction reverse to the discharging direction. This direction may be hereinafter referred to as "re-conveying direction". When the switch-back rollers 71 are rotated in the re-conveying direction, the sheet S conveyed from the fixing unit 60 to the discharger 7 is conveyed toward the image forming unit 5 again.

That is, the switch-back rollers 71 are rotatable selectively in one of a first mode in which the switch-back rollers 71 convey the sheet S in a direction directed from the image forming unit 5 toward the output tray 72 and a second mode in which the switch-back rollers 71 convey the sheet S in a direction directed from the output tray 72 toward a re-conveyance path L2.

The image forming apparatus 1 defines the re-conveyance path L2 below the image forming unit 5. In the second mode, the sheet S conveyed by the switch-back rollers 71 rotated in the re-conveying direction is conveyed toward the image forming unit 5 along the re-conveyance path L2 again. The re-conveyance path L2 is one example of a sheet conveyance path through which the sheet S with the image formed on one of its opposite surfaces by the image forming unit 5 is conveyed toward the image forming unit 5 again.

The sheet S conveyed to the re-conveyance path L2 is further conveyed toward the image forming unit 5 by a second re-conveying roller 36*a* and a first re-conveying roller 35*a* provided on the re-conveyance path L2. A second driven roller 36*b* is opposed to the second re-conveying roller 36*a*. A first driven roller 35*b* is opposed to the first re-conveying roller 35*a*. The second driven roller 36*b* is one example of a driven roller being in close contact with the second re-conveying roller.

The re-conveyance path L2 branches off from the conveyance path L1 at a branch position located between the fixing unit 60 and the discharger 7. The re-conveyance path L2 merges with the conveyance path L1 at a merging position located between the conveying rollers 33*a*, 33*b* and the registering rollers 34.

The re-conveyance path L2 includes: a main path L2*a* which is defined below the image forming unit 5 and in which a first re-conveying roller 35 and a second re-conveying roller 36 are disposed; a first curved path L2*b* defined between the branch position and the main path L2*a*; and a second curved path L2*c* defined between the main path L2*a* and the merging position. A chute member 15 is provided below the main path L2*a*. The chute member 15 defines at least a portion of the re-conveyance path L2 and supports the first re-conveying roller 35 and the second re-conveying roller 36.

The image forming apparatus 1 is capable of performing duplex printing in which the sheet S with the image formed on one of its opposite surfaces by the image forming unit 5 is conveyed to the image forming unit 5 again via the re-conveyance path L2 by the re-conveyor 8 having the re-conveyance path L2, and an image is formed on the other surface of the sheet S.

The image forming apparatus 1 includes a conveyor transmission mechanism 11, a switch-back-roller transmission mechanism 12, and a re-conveying-roller transmission mechanism 20. Components such as the registering rollers 34 constituting the conveyor are rotated by the driving force supplied from the motor 4 and transmitted via the conveyor transmission mechanism 11.

In the case where the motor 4 is being rotated in a forward direction, the conveyor transmission mechanism 11 transmits the driving force from the motor 4 to the conveyor to rotate each of the components including the registering rollers 34 in a direction in which the sheet S is conveyed toward the discharger 7. In the case where the motor 4 is being rotated in a reverse direction, the conveyor transmission mechanism 11 transmits no driving force from the motor 4 to the components including the registering rollers 34.

The switch-back rollers 71 are rotated by the driving force supplied from the motor 4 and transmitted via the switch-back-roller transmission mechanism 12. When the motor 4 is being rotated in the forward direction, the switch-back-roller transmission mechanism 12 rotates the switch-back rollers 71 in the first mode. When the motor 4 is being rotated in the reverse direction, the switch-back-roller transmission mechanism 12 rotates the switch-back rollers 71 in the second mode.

The first re-conveying roller 35*a* and the second re-conveying roller 36*a* are rotated by the driving force supplied from the motor 4 and transmitted via the re-conveying-roller transmission mechanism 20. The re-conveying-roller transmission mechanism 20 is operable in a first transmission mode and a second transmission mode. In the first transmission mode, the re-conveying-roller transmission mechanism 20 transmits the rotational driving force supplied from the motor 4, to the first re-conveying roller 35*a* and the second re-conveying roller 36*a* without reversing the rotational driving force. In the second transmission mode, the re-conveying-roller transmission mechanism 20 reverses and transmits the rotational driving force supplied from the motor 4, to the first re-conveying roller 35*a* and the second re-conveying roller 36*a*.

Specifically, in the case where the motor 4 is being rotated in the reverse direction, the re-conveying-roller transmission mechanism 20 is operated in the first transmission mode and outputs the driving force supplied from the motor 4, to the first re-conveying roller 35*a* and the second re-conveying roller 36*a*. As a result, the driving force in the direction for conveying the sheet S from the branch position toward the merging position is transmitted to the first re-conveying roller 35*a* and the second re-conveying roller 36*a*.

When the rotational direction of the motor 4 is switched from the reverse direction to the forward direction, the transmission mode of the re-conveying-roller transmission mechanism 20 is switched to the second transmission mode to reverse and output the driving force supplied from the motor 4, to the first re-conveying roller 35*a* and the second re-conveying roller 36*a*. As a result, the driving force in the direction for conveying the sheet S from the branch position toward the merging position is transmitted to the first re-conveying roller 35*a* and the second re-conveying roller 36*a*.

The operation of the re-conveying-roller transmission mechanism 20 in the second transmission mode when the rotational direction of the motor 4 is switched from the reverse direction to the forward direction is continued a particular length of time from the switch of the rotational direction of the motor 4, and thereafter the transmission of the driving force from the re-conveying-roller transmission mechanism 20 to the first re-conveying roller 35*a* and the second re-conveying roller 36*a* is interrupted.

That is, after the rotational direction of the driving force supplied by the motor 4 is switched from the reverse direction to the forward direction, the re-conveying-roller transmission mechanism 20 transmits the driving force in the direction for conveying the sheet S from the branch position toward the merging position, to the first re-conveying roller 35*a* and the second re-conveying roller 36*a* until the sheet S conveyed again reaches the registering rollers 34.

When sheet S conveyed again has reached the registering rollers 34 and is conveyed by the registering rollers 34, the driving force is not transmitted to the first re-conveying roller 35*a* and the second re-conveying roller 36*a*. In this case, at the point in time when the registering rollers 34 starts conveying the leading edge portion of the sheet S conveyed again, the sheet S is still nipped between the first re-conveying roller 35*a* and the first driven roller 35*b*, and the first re-conveying roller 35*a* is rotated by the sheet S conveyed by the registering rollers 34.

Thus, the motor 4 supplies the driving force for conveying the sheet S, to the registering rollers 34, the switch-back rollers 71 of the discharger 7, the first re-conveying roller 35*a*, and the second re-conveying roller 36*a* constituting the conveyor. The rotation of the motor 4 in the forward direction, the rotation of the motor 4 in the reverse direction, and a stopping operation of the motor 4 are controlled by a controller 41 of the image forming apparatus 1.

In the image forming apparatus 1, a re-conveyor 80 is constituted by components including the re-conveyance path L2, the chute member 15, the first re-conveying roller 35*a*, the first driven roller 35*b*, the second re-conveying roller 36*a*, the second driven roller 36*b*, and the re-conveying-roller transmission mechanism 20.

Configuration of Re-Conveyor

There will be next described a configuration of the re-conveyor 8. As illustrated in FIGS. 2-5, the re-conveyor 8 includes the chute member 15, the first re-conveying roller 35*a*, a first bevel gear 21, a second bevel gear 22, a first shaft member 23, a first engaged member 24, a second engaged member 25, an engaging member 26, a third bevel gear 27, a second shaft member 28, a fourth bevel gear 29, and the second re-conveying roller 36*a*. The first bevel gear 21, the second bevel gear 22, the first shaft member 23, the first engaged member 24, the second engaged member 25, the engaging member 26, the third bevel gear 27, the second shaft member 28, and the fourth bevel gear 29 constitute the re-conveying-roller transmission mechanism 20.

The chute member 15 includes a bottom plate 15*a* and a plurality of ribs 15*b*. The bottom plate 15*a* is shaped like a plate extending in the front and rear direction and the right and left direction. A rear end portion of the bottom plate 15*a* is curved so as to be higher at its rear end than at the other portion. Each of the ribs 15*b* protrudes upward from the bottom plate 15*a* and extends in the front and rear direction. Upper ends of the respective ribs 15*b* are located at the same height to support a lower surface of the sheet S conveyed along the re-conveyance path L2. A rear end portion of the ribs 15*b* is curved so as to be higher at its rear end than at the other portion.

The first re-conveying roller 35*a* is a conveying roller that conveys the sheet S along the re-conveyance path L2. The driving force is transmitted from the motor 4 to the first bevel gear 21. The first bevel gear 21 includes a rotation shaft 21*a* extending along the right and left direction. The first bevel gear 21 is rotatable about the rotation shaft 21*a*.

The second bevel gear 22 is engaged with the first bevel gear 21 and rotated about a first axis A1 extending in the front and rear direction (that is a direction in which the first axis A1 extends and that is one example of a first direction). It is noted that the direction in which the first axis A1 extends may be hereinafter referred to as "axis A1 direction". The first axis A1 is one example of an axis. The axis of the rotation shaft 21*a* and the first axis A1 are orthogonal to each other. The second bevel gear 22 is rotated by a driving force transmitted from the first bevel gear 21. The second bevel gear 22 is rotated in the direction indicated by the arrow in FIG. 4 by the driving force transmitted from the first bevel gear 21. The direction in which the second bevel gear 22 is rotated by the driving force transmitted from the first bevel gear 21 is a rotational direction of the second bevel gear 22.

The first shaft member 23 transmits the driving force transmitted from the second bevel gear 22, to the first re-conveying roller 35*a*. It is noted that the first shaft member 23 constitutes a portion of the re-conveying-roller transmission mechanism 20 configured to transmit the driving force from the second bevel gear 22 to the first re-conveying roller 35*a*. The first shaft member 23 extends along the axis A1 direction. The first engaged member 24 is provided on a front portion of the second bevel gear 22, in other words, the first engaged member 24 is provided on a one-side portion of the second bevel gear 22 in the axis A1 direction. The first engaged member 24 is rotated together with the second bevel gear 22. That is, the first engaged member 24 is integrally formed on or fixed to one of opposite end portions of the second bevel gear 22 in the first axis A1, which one is nearer to the first shaft member 23 than the other in the first axis A1. The second engaged member 25 is provided on a rear portion of the first shaft member 23, in other words, the second engaged member 25 is provided on an other-side portion of the first shaft member 23 in the axis A1 direction. The second engaged member 25 is rotated together with the first shaft member 23. That is, the second engaged member 25 is integrally formed on or fixed to one of opposite end portions of the first shaft member 23 in the first axis A1, which one is nearer to the second bevel gear 22 than the other in the first axis A1. It is noted that, since each of the first shaft member 23, the first engaged member 24, the second engaged member 25, and the engaging member 26, which will be described below, is rotated about the axis extending in the front and rear direction, the axis of each of the first shaft member 23, the first engaged member 24, the second engaged member 25, and the engaging member 26 coincides with the first axis A1 of the second bevel gear. It is further noted that the one side (as one example of a first side) and the other side (as one example of a second side) in the axis A1 direction coincide respectively with the front side and the rear side.

Figure 6A:
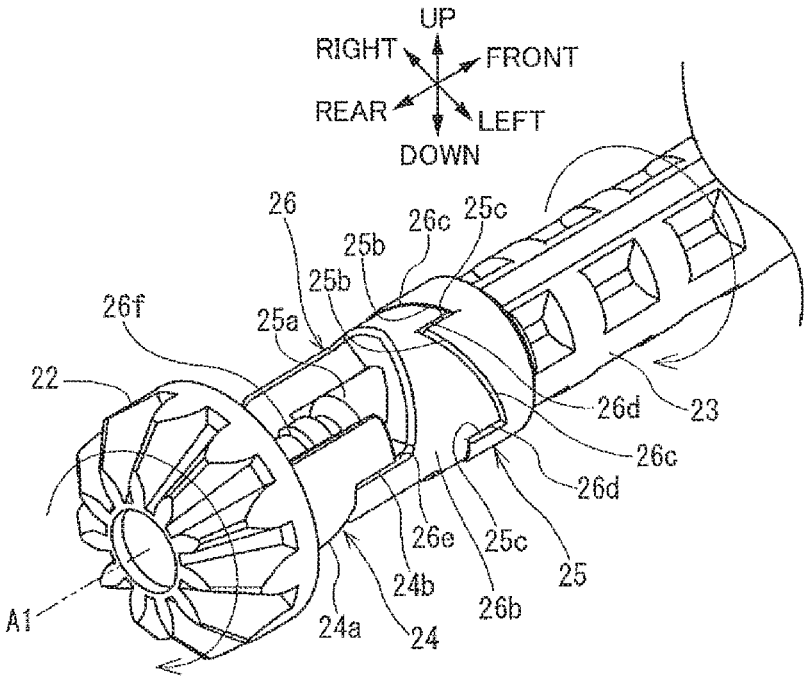
FIGS. 6A and 6B are views each illustrating a state in which an engaging member is located at a second position.
Figure 6B:
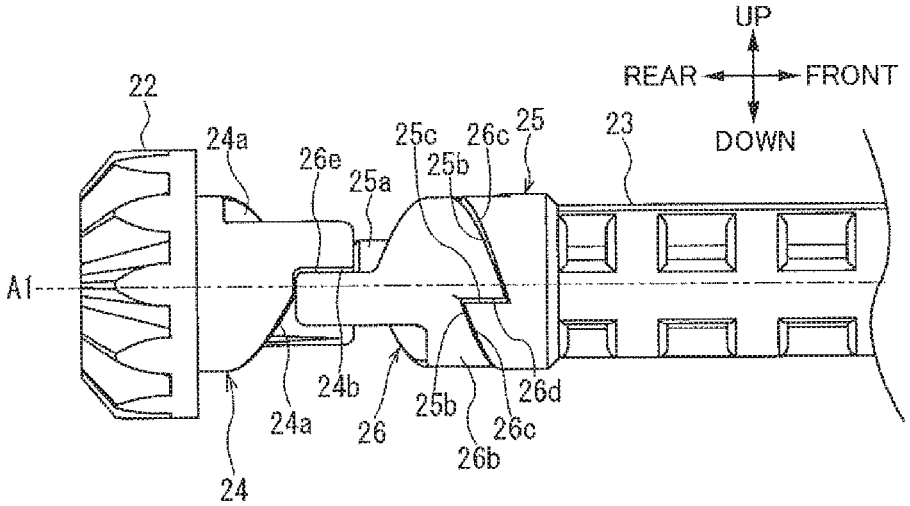
Figure 7A:
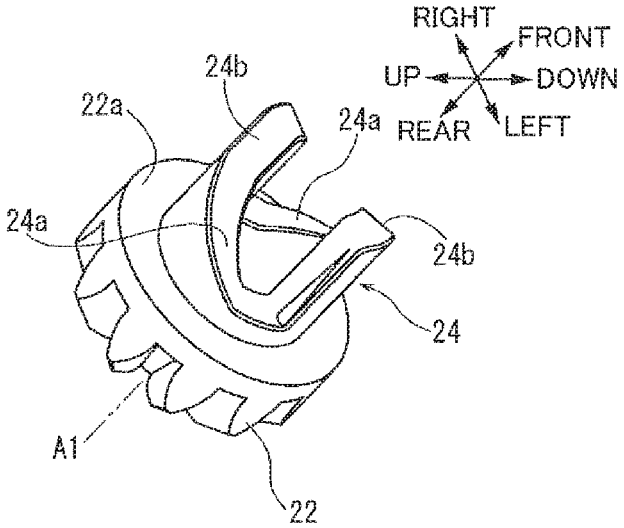
FIGS. 7A and 7B are views of a first engaged member.
Figure 7B:
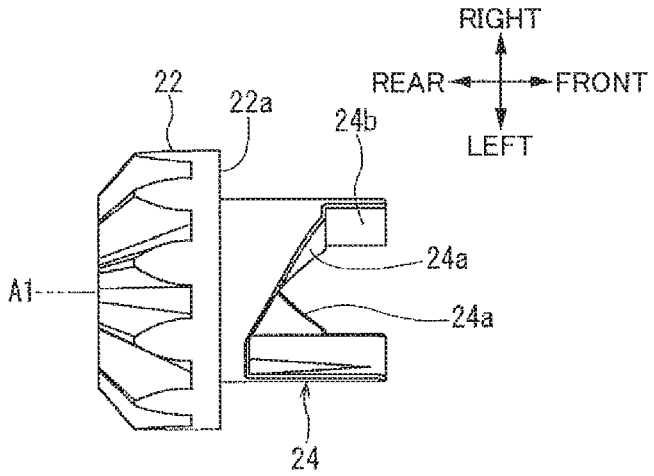
Figure 8A:
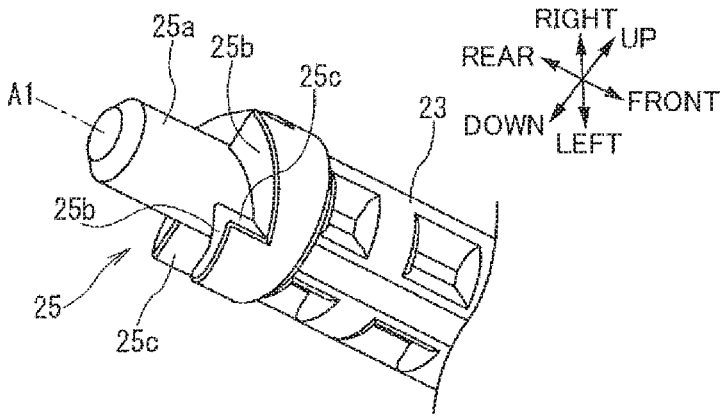
FIGS. 8A and 8B are views of a second engaged member.
Figure 8B:
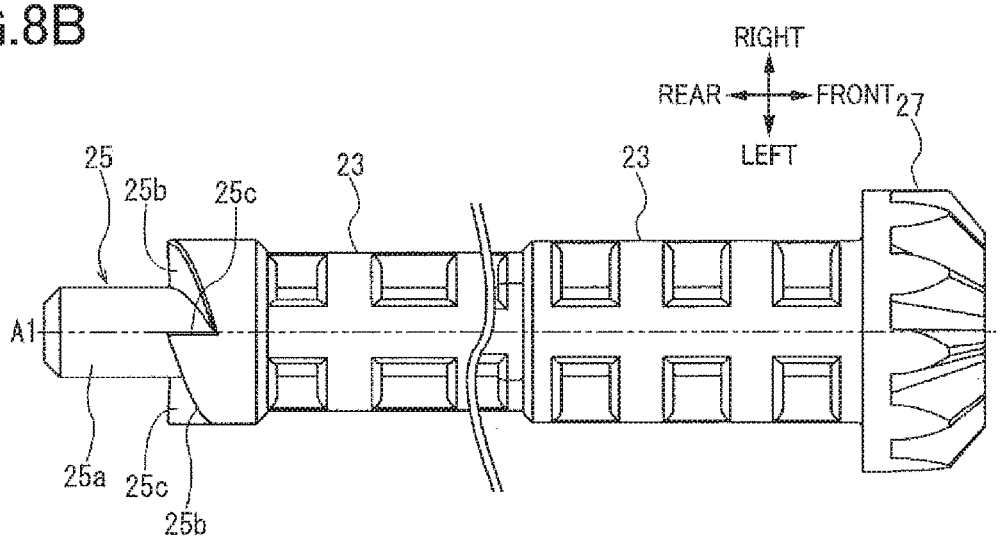
Figure 9A:
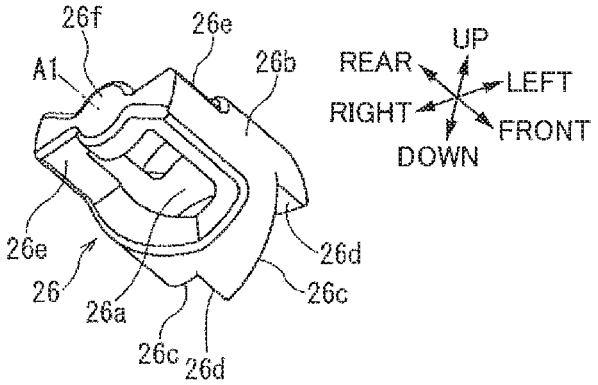
FIGS. 9A through 9C are views of the engaging member.
Figure 9B:
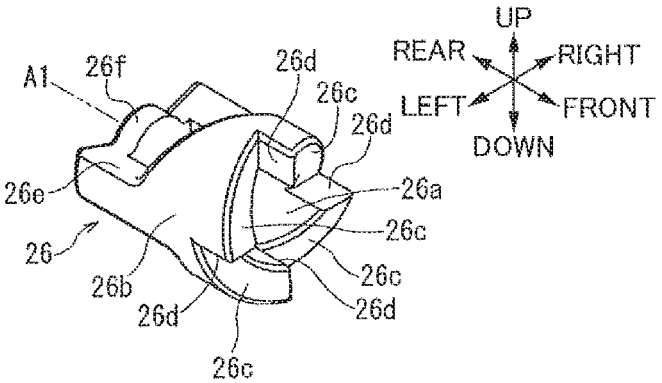
Figure 9C:
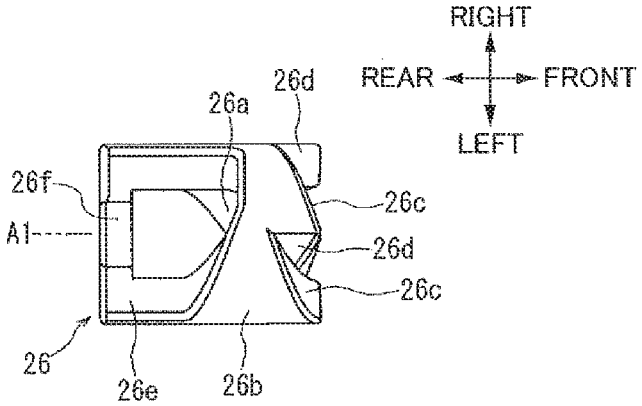
Figure 10A:
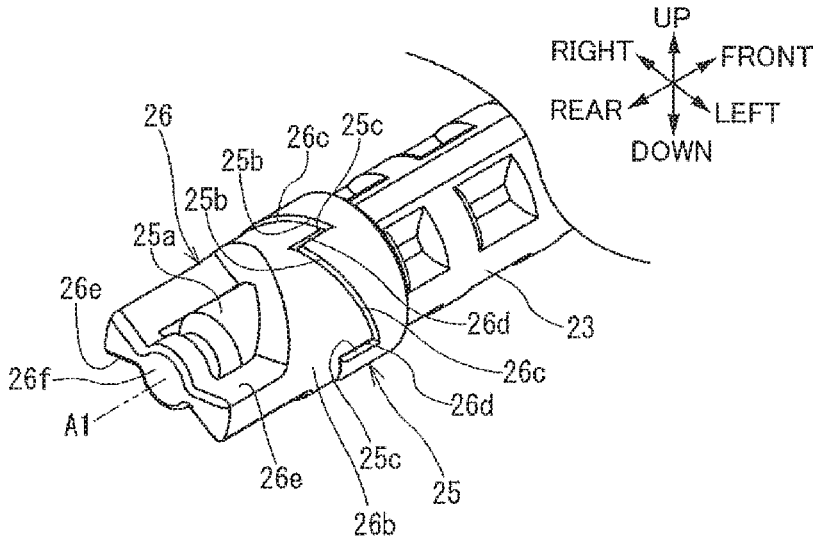
FIGS. 10A and 10B are views of a closing portion of the engaging member.
Figure 10B:
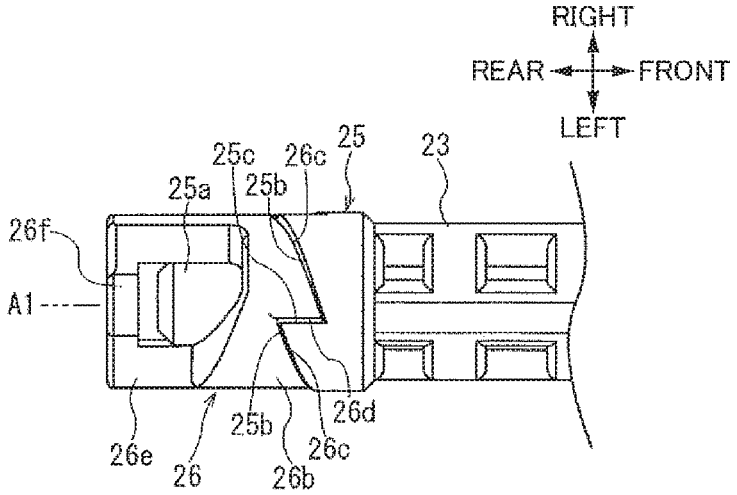

The engaging member 26 is disposed between the first engaged member 24 and the second engaged member 25 in the axis A1 direction and movable in the axis A1 direction between a first position (illustrated in FIGS. 11A and 11B) and a second position (illustrated in FIGS. 6A and 6B). At the first position, the engaging member 26 is engaged only with the first engaged member 24. At the second position, the engaging member 26 is engaged with the first engaged member 24 and the second engaged member 25.

The third bevel gear 27 is provided on a one-side end portion of the first shaft member 23 in the axis A1 direction and rotatable about the first axis A1 together with the first shaft member 23. The second shaft member 28 extends along a second axis A2 extending in the right and left direction orthogonal to the first axis A1. It is noted that a direction in which the second axis A2 extends may be hereinafter referred to as "axis A2 direction". The first re-conveying roller 35*a* is integrally rotatably provided on a right end portion of the second shaft member 28, i.e., a one-side end portion of the second shaft member 28 in the axis A2 direction. The axis A2 direction and the axis direction of the rotation shaft 21*a* are parallel with each other.

The fourth bevel gear 29 is integrally rotatably provided on a left end portion of the second shaft member 28, i.e., an other-side end portion of the second shaft member 28 in the axis A2 direction. The third bevel gear 27 and the fourth bevel gear 29 are engaged with each other, and the fourth bevel gear 29 is rotated upon receiving a driving force from the third bevel gear 27. The third bevel gear 27 is rotated upon receiving a driving force from the fourth bevel gear 29.

The second re-conveying roller 36*a* is directly connected to the rotation shaft 21*a* of the first bevel gear 21 and rotatable together with the first bevel gear 21. When the first bevel gear 21 is driven, the second re-conveying roller 36*a* is rotated to convey the sheet S nipped between the second re-conveying roller 36*a* and the second driven roller 36*b*, along the re-conveyance path L2. The second driven roller 36*b* disposed above the second re-conveying roller 36*a* so as to be opposed to the second re-conveying roller 36 is in close contact with the second re-conveying roller 36*a*.

In the re-conveying-roller transmission mechanism 20, the first bevel gear 21, the second bevel gear 22, the first engaged member 24, the engaging member 26, the second engaged member 25, the first shaft member 23, the third bevel gear 27, the fourth bevel gear 29, the second shaft member 28, and the first re-conveying roller 35*a* are arranged in this order in a direction in which the driving force is transmitted.

At a left end portion of the chute member 15, the first bevel gear 21, the second bevel gear 22, the first engaged member 24, the engaging member 26, the second engaged member 25, the first shaft member 23, and the third bevel gear 27 are arranged in this order in the front direction from a substantially central portion of the chute member 15 in the front and rear direction. At a front end portion of the chute member 15, the fourth bevel gear 29, the second shaft member 28, and the first re-conveying roller 35*a* are arranged in a direction from a left end portion of the chute member 15 toward a central portion of the chute member 15 in the right and left direction.

In the case where the right and left direction that is a direction orthogonal to the sheet conveying direction in the re-conveyance path L2 is defined as a widthwise direction, the first bevel gear 21, the second bevel gear 22, the first engaged member 24, the engaging member 26, the second engaged member 25, the first shaft member 23, the third bevel gear 27, and the fourth bevel gear 29 are disposed outside an area of the re-conveyance path L2 in the widthwise direction.

As illustrated in FIGS. 6A-7B, the first engaged member 24 includes: first inclined portions 24*a* (each as one example of a first converting inclined portion) each having an inclined surface which is inclined such that a downstream portion of the inclined surface in the rotational direction of the second bevel gear 22 is located on the other side, in the axis A1 direction, of an upstream portion of the inclined surface in the rotational direction of the second bevel gear 22; and first engaged portions 24*b* each provided at an upstream end portion of a corresponding one of the first inclined portions 24*a* in the rotational direction.

As illustrated in FIGS. 6A, 6B, 8A, and 8B, the second engaged member 25 includes: a protrusion 25*a* protruding from the other-side end portion of the first shaft member 23 toward the other side in the axis A1 direction; a second inclined portion 25*b* (as one example of a second converting inclined portion) disposed around the protrusion 25*a* and having an inclined surface which is inclined such that a downstream portion of the inclined surface in the rotational direction is located on the one side, in the axis A1 direction, of an upstream portion of the inclined surface in the rotational direction; and a second engaged portion 25*c* provided at a downstream end portion of the second inclined portion 25*b* in the rotational direction.

As illustrated in FIGS. 6A, 6B, and 9A-9C, the engaging member 26 includes: a body portion 26*b* having a fitting hole 26*a* in which the protrusion 25*a* is inserted slidably in the axis A1 direction; a third inclined portion 26*c* (as one example of a second converting inclined portion) formed on the body portion 26*b*, contactable with the second inclined portion 25*b*, and having an inclined surface which is inclined such that a downstream portion of the inclined surface in the rotational direction is located on the one side, in the axis A1 direction, of an upstream portion of the inclined surface in the rotational direction; and an engaging portion 26*d* (as one example of a second engaging portion) provided at a downstream end portion of the third inclined portion 26*c* in the rotational direction and engageable with the second engaged portion 25*c*. That is, the engaging portion 26*d* is one of opposite end portions of the engaging member 26 in the axis A1 direction, which one is nearer to the second engaged portion 25*c* than the other, and the engaging portion 26*d* is engageable with the second engaged portion 25*c*.

The engaging member 26 includes first contact portions 26*e* (each as one example of a first engaging portion) each extending from the body portion 26*b* toward the other side in the axis A1 direction and engageable with a corresponding one of the first engaged portions 24*b* while contacting a corresponding one of the first inclined portions 24*a*. That is, the first contact portions 26*e* are one of opposite end portions of the engaging member 26 in the axis A1 direction, which one is nearer to the first engaged member 24 than the other, and the first contact portions 26*e* are engageable with the first engaged member 24. The engaging member 26 has a closing portion 26*f* coupled to the two first contact portions 26*e* and located at a position overlaying the fitting hole 26*a* when viewed in the axis A1 direction. The slidable insertion of the protrusion 25*a* in the fitting hole 26*a* enables the engaging member 26 to slide along the axis A1 direction.

As illustrated in FIGS. 9A-10B, the protrusion 25*a* is inserted in the fitting hole 26*a* of the engaging member 26 from the end portion of the engaging member 26, in the axis A1 direction, at which the third inclined portion 26*c* is formed. This insertion enables contact between the second inclined portion 25*b* and the third inclined portion 26*c* and engagement between the second engaged portion 25*c* and the engaging portion 26*d*.

The closing portion 26*f* is formed at the end portion of the engaging member 26, in the axis A1 direction, at which the first contact portions 26*e* is formed. Since the closing portion 26*f* is located at the position overlaying the fitting hole 26*a* when viewed in the axis A1 direction and closes the fitting hole 26*a*, it is impossible to insert the protrusion 25*a* into the fitting hole 26*a* from the end portion of the engaging member 26 at which the first contact portions 26*e* is formed.

Since the engaging member 26 has the closing portion 26*f*, it is possible to prevent the protrusion 25*a* from being inserted into the fitting hole 26*a* from the end portion of the engaging member 26 at which the first contact portions 26*e* is formed. This facilitates assembly of the components.

In the re-conveying-roller transmission mechanism 20, the engaging member 26 is slidably inserted on the protrusion 25*a* of the second engaged member 25 and thereby movable between the first position and the second position. This movement switches between transmission and non-transmission of the driving force between the second bevel gear 22 and the first shaft member 23, enabling reduction in size of a mechanism for switching between the transmission and the non-transmission of the driving force between the second bevel gear 22 and the first shaft member 23.

Operations of Re-Conveying-Roller Transmission Mechanism

In the re-conveyor 8 configured as described above, the re-conveying-roller transmission mechanism 20 is operated as follows. In the re-conveying-roller transmission mechanism 20, as illustrated in FIGS. 6A and 6B, when the second bevel gear 22 is rotated in the rotational direction by the driving force transmitted from the first bevel gear 21, the engaging member 26 is moved to the second position and engaged with the first engaged member 24 and the second engaged member 25 to rotate the first shaft member 23 in the rotational direction.

Specifically, when the second bevel gear 22 is rotated in the rotational direction by the driving force transmitted from the first bevel gear 21, the first engaged member 24 is also rotated in the rotational direction with the second bevel gear 22. For example, when the first engaged member 24 is rotated in the rotational direction in the state in which the engaging member 26 is located at the first position, the first inclined portions 24*a* of the first engaged member 24 are moved toward the first contact portions 26*e* of the engaging member 26 to come into contact with the first contact portions 26*e*. When the first engaged member 24 is rotated in the rotational direction in the state in which the first inclined portions 24*a* and the first contact portions 26*e* are in contact with each other, the first contact portions 26*e* are pressed by the respective first inclined portions 24*a* toward the one side in the axis A1 direction, so that the engaging member 26 is moved toward the one side in the axis A1 direction. In other words, the rotational power of the first engaged member 24 about the axis A1 direction is converted, by movement of the first contact portions 26*e* on the respective first inclined portions 24*a*, to a force that is applied from the first engaged member 24 to the engaging member 26 in a direction directed from the first position toward the second position. That is, each of the first inclined portions 24*a* serves as a converting inclined portion that converts the direction of the force. It is noted that the image forming apparatus 1 may be configured such that the engaging member 26 has an inclined portion, and the first engaged member 24 has a contact portion contactable with the inclined portion. That is, in the case where the image forming apparatus 1 is configured such that at least one of the first engaged member 24 and the engaging member 26 has an inclined portion, and the other has a contact portion contactable with the inclined portion, the force in the direction directed from the first position toward the second position is applied to the engaging member 26.

When the engaging member 26 moving toward the one side in the axis A1 direction has reached the second position, the first contact portions 26*e* of the engaging member 26 and the first engaged portions 24*b* of the first engaged member 24 are respectively engaged with each other, so that the first contact portions 26*e* are pressed by the respective first engaged portions 24*b* in the rotational direction. As a result, the first engaged member 24 and the engaging member 26 are rotated in the rotational direction together with each other.

When the third inclined portion 26*c* of the engaging member 26 has come into contact with the second inclined portion 25*b* of the second engaged member 25, and the engaging member 26 has reached the second position in a process in which the engaging member 26 is moved to the second position, the engaging portion 26*d* of the engaging member 26 is engaged with the second engaged portion 25*c* of the second engaged member 25. The engaging member 26 moved to the second position is rotated in the rotational direction by the first engaged member 24, and the engaging portion 26*d* of the engaging member 26 is engaged with the second engaged portion 25*c* of the second engaged member 25, whereby the second engaged member 25 is also rotated in the rotational direction together with the engaging member 26.

When the second engaged member 25 is rotated in the rotational direction, the first shaft member 23 and the third bevel gear 27 are also rotated in the rotational direction together with each other. When the third bevel gear 27 is rotated in the rotational direction, the driving force is transmitted also to the fourth bevel gear 29, the second shaft member 28, and the first re-conveying roller 35*a*, and the second re-conveying roller 36*a* is rotated so as to convey the sheet S in the direction directed from the branch position toward the merging position.

In this case, when the driving force is transmitted from the first bevel gear 21 to the second bevel gear 22, a thrust force that moves the second bevel gear 22 toward the one side in the axis A1 direction is applied from the first bevel gear 21 to the second bevel gear 22. This prevents generation of an excess space between the first shaft member 23 and the second bevel gear 22, making it possible to appropriately keep the positional relationship between the first shaft member 23 and the second bevel gear 22 in the axis A1 direction.

In the re-conveying-roller transmission mechanism 20, the mechanism for switching between (i) the first transmission mode in which the re-conveying-roller transmission mechanism 20 transmits the rotational driving force supplied from the motor 4, to the first re-conveying roller 35*a* and the second re-conveying roller 36*a* without reversing the rotational driving force and (ii) the second transmission mode in which the re-conveying-roller transmission mechanism 20 reverses and transmits the rotational driving force supplied from the motor 4, to the first re-conveying roller 35*a* and the second re-conveying roller 36*a* is provided upstream of the first bevel gear 21 in the direction in which the driving force is transmitted.

Figure 11A:
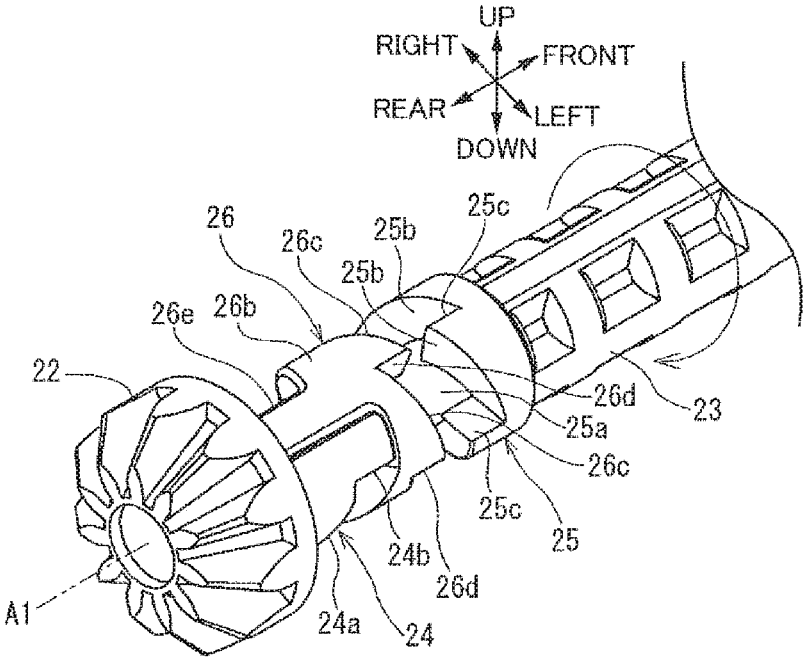
FIGS. 11A and 11B are views each illustrating a state in which an engaging member is located at a first position.
Figure 11B:
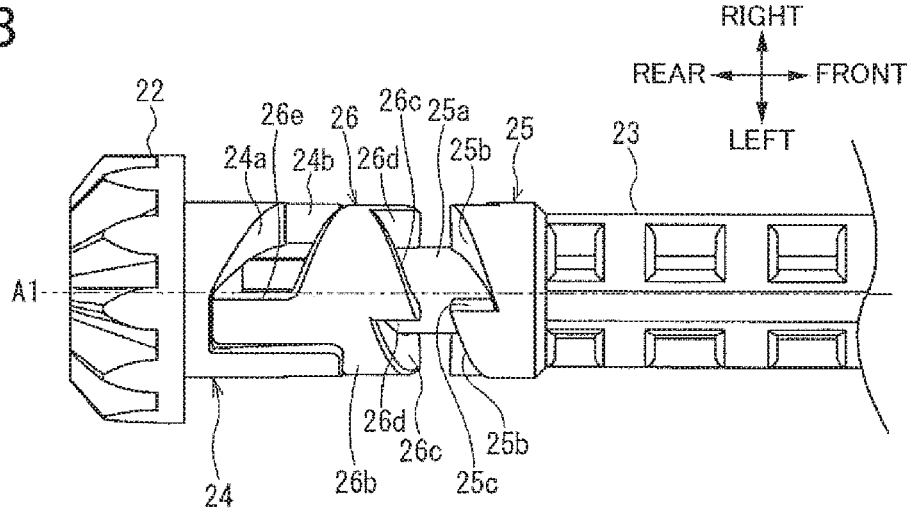

In the re-conveying-roller transmission mechanism 20, as illustrated in FIGS. 11A and 11B, when the first shaft member 23 is rotated in the rotational direction by the driving force transmitted from the first re-conveying roller 35*a*, the engaging member 26 is moved to the first position. In this movement, the engaging member 26 is disengaged from the second engaged member 25 and engaged with the first engaged member 24 to interrupt transmission of the driving force from the first shaft member 23 to the second bevel gear 22.

Specifically, when the first shaft member 23 is rotated in the rotational direction by the driving force transmitted from the first re-conveying roller 35*a*, the second engaged member 25 is also rotated in the rotational direction together with the first shaft member 23. For example, when the second engaged member 25 is rotated in the rotational direction in a state in which the engaging member 26 is moving to the second position, the second inclined portion 25*b* of the second engaged member 25 presses the third inclined portion 26*c* of the engaging member 26 toward the other side in the axis A1 direction. When the third inclined portion 26*c* is pressed by the second inclined portion 25*b*, the engaging member 26 is moved toward the other side in the axis A1 direction. In other words, the rotational power of the second engaged member 25 about the axis A1 direction is converted, by movement of the third inclined portion 26*c* on the second inclined portion 25*b*, to a force that is applied from the second engaged member 25 to the engaging member 26 in a direction directed from the second position toward the first position. That is, the second inclined portion 25*b* serves as a converting inclined portion that converts the direction of the force. It is noted that one of the second inclined portion 25*b* and the third inclined portion 26*c* may be replaced with a contact portion. That is, in the case where the image forming apparatus 1 is configured such that at least one of the second engaged member 25 and the engaging member 26 has an inclined portion, and the other has a contact portion contactable with the inclined portion, the force in the direction directed from the second position toward the first position is applied to the engaging member 26.

When the engaging member 26 moved in the other side in the axis A1 direction has reached the first position, the engaging member 26 is located at a position at which the engaging portion 26*d* and the second engaged portion 25*c* are not engaged with each other in the axis A1 direction, and accordingly the engaging member 26 and the second engaged member 25 are disengaged from each other. This disengagement interrupts the transmission of the driving force from the first shaft member 23 to the second bevel gear 22.

In the image forming apparatus 1, when the sheet S conveyed by the first re-conveying roller 35*a* along the re-conveyance path L2 has reached the registering rollers 34 in the state in which the re-conveying-roller transmission mechanism 20 is being operated in the second transmission mode by switching of the rotational direction of the motor 4 from the reverse direction to the forward direction, transmission of the driving force to the first re-conveying roller 35*a* is interrupted, so that the sheet S is conveyed by the registering rollers 34. In this case, the first re-conveying roller 35*a* is rotated by the sheet S conveyed by the registering rollers 34, and the first shaft member 23 is rotated in the rotational direction by the rotation of the first re-conveying roller 35*a*. It is noted that the driving force is not transmitted to the first bevel gear 21 while the first re-conveying roller 35*a* is rotated by the sheet S.

Thus, when the first shaft member 23 is rotated in the rotational direction by the driving force transmitted from the first re-conveying roller 35*a*, the engaging member 26 interrupts the transmission of the driving force from the first shaft member 23 to the second bevel gear 22. Accordingly, a load acting on the components nearer to the second bevel gear 22 than to the first shaft member 23 does not act on the first re-conveying roller 35*a*. This reduces the load acting on the first re-conveying roller 35*a*, making it possible to reduce the possibility of lowered accuracy of conveyance of the sheet S by the first re-conveying roller 35*a*.

In particular, the second re-conveying roller 36*a* held in close contact with the second driven roller 36*b* is directly connected to the first bevel gear 21 engaged with the second bevel gear 22, which imposes a heavy load on the first bevel gear 21. When the first shaft member 23 is rotated in the rotational direction by the driving force transmitted from the first re-conveying roller 35*a*, however, the transmission of the driving force between the first shaft member 23 and the second bevel gear 22 is interrupted. Thus, the heavy load acting on the first bevel gear 21 does not act on the first re-conveying roller. This reduces a large amount of the load acting on the first re-conveying roller 35*a*, making it possible to reduce the possibility of lowered accuracy of conveyance of the sheet S by the first re-conveying roller 35*a*.

When the first re-conveying roller 35*a* is rotated by the sheet S, and the driving force is transmitted to the third bevel gear 27 from the fourth bevel gear 29 rotated together with the first re-conveying roller 35*a*, a thrust force that moves the third bevel gear 27 toward the other side in the axis A1 direction is applied from the fourth bevel gear 29 to the third bevel gear 27. This prevents generation of an excess space between the first shaft member 23 and the second bevel gear 22, making it possible to appropriately keep the positional relationship between the first shaft member 23 and the second bevel gear 22 in the axis A1 direction.

Covering Member

Figure 12A:
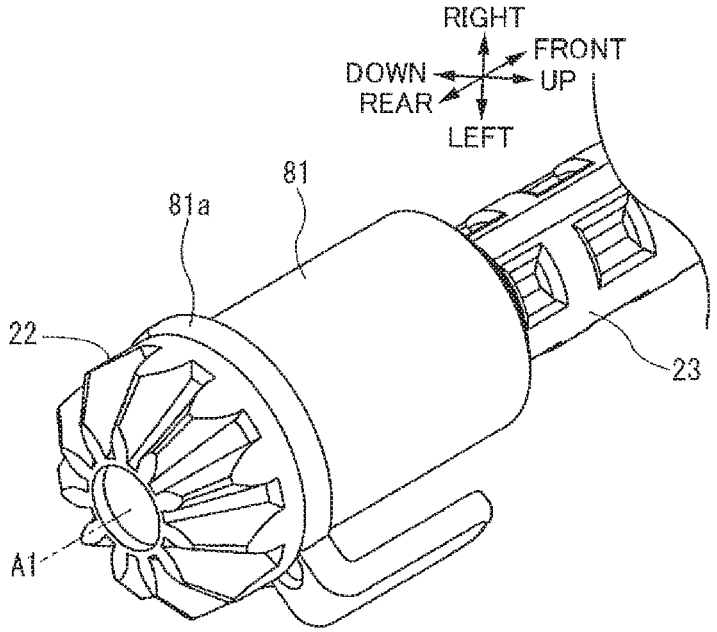
FIGS. 12A and 12B are views of a covering member.
Figure 12B:
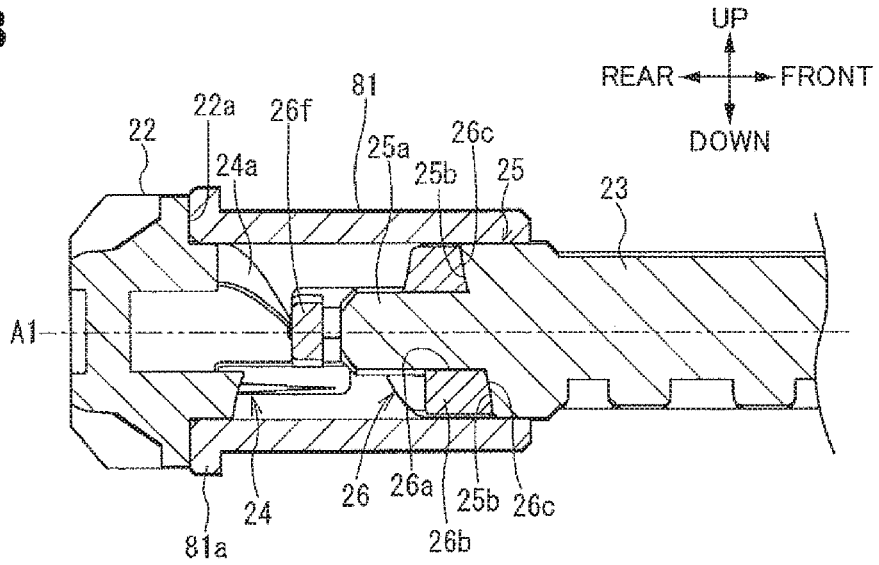

As illustrated in FIGS. 12A and 12B, the re-conveying-roller transmission mechanism 20 includes a covering member 81. The covering member 81 is a cylindrical member disposed along the axis A1 direction and covering outer peripheral surfaces of the first engaged member 24, the second engaged member 25, and the engaging member 26. The engaging member 26 is slidable in the axis A1 direction in the covering member 81.

A one-side end portion of the covering member 81 in the axis A1 direction is disposed on the one side of the second inclined portion 25*b* and the second engaged portion 25*c* of the second engaged member 25 in the axis A1 direction. That is, the covering member 81 covers the second engaged member 25 at the one-side end portion of the covering member 81 such that the second inclined portion 25*b* and the second engaged portion 25*c* are not exposed.

This covering member 81 prevents ingress of foreign matters such as paper dust into a space between the second inclined portion 25*b* of the second engaged member 25 and the third inclined portion 26*c* of the engaging member 26 and a space between the second engaged portion 25*c* of the second engaged member 25 and the engaging portion 26*d* of the engaging member 26. With this configuration, for example, when the engaging member 26 is moved to the second position, engagement of the second engaged portion 25*c* and the engaging portion 26*d* is not hindered, enabling appropriate transmission of the driving force from the second bevel gear 22 to the first shaft member 23.

The covering member 81 includes a brim portion 81*a* provided at an other-side end portion of the covering member 81 in the axis A1 direction and protruding outward in the radial direction. The brim portion 81*a* is one example of a second contact portion. The brim portion 81*a* is held in contact with a contacted surface 22*a* of the second bevel gear 22. Since the covering member 81 includes the brim portion 81*a* held in contact with the second bevel gear 22, when the second bevel gear 22 is driven by the first bevel gear 21, the thrust force generated on the second bevel gear 22 in the axis A1 direction is received by the brim portion 81*a*, thereby positioning the second bevel gear 22 in the axis A1 direction.

Bearing

Figure 3:
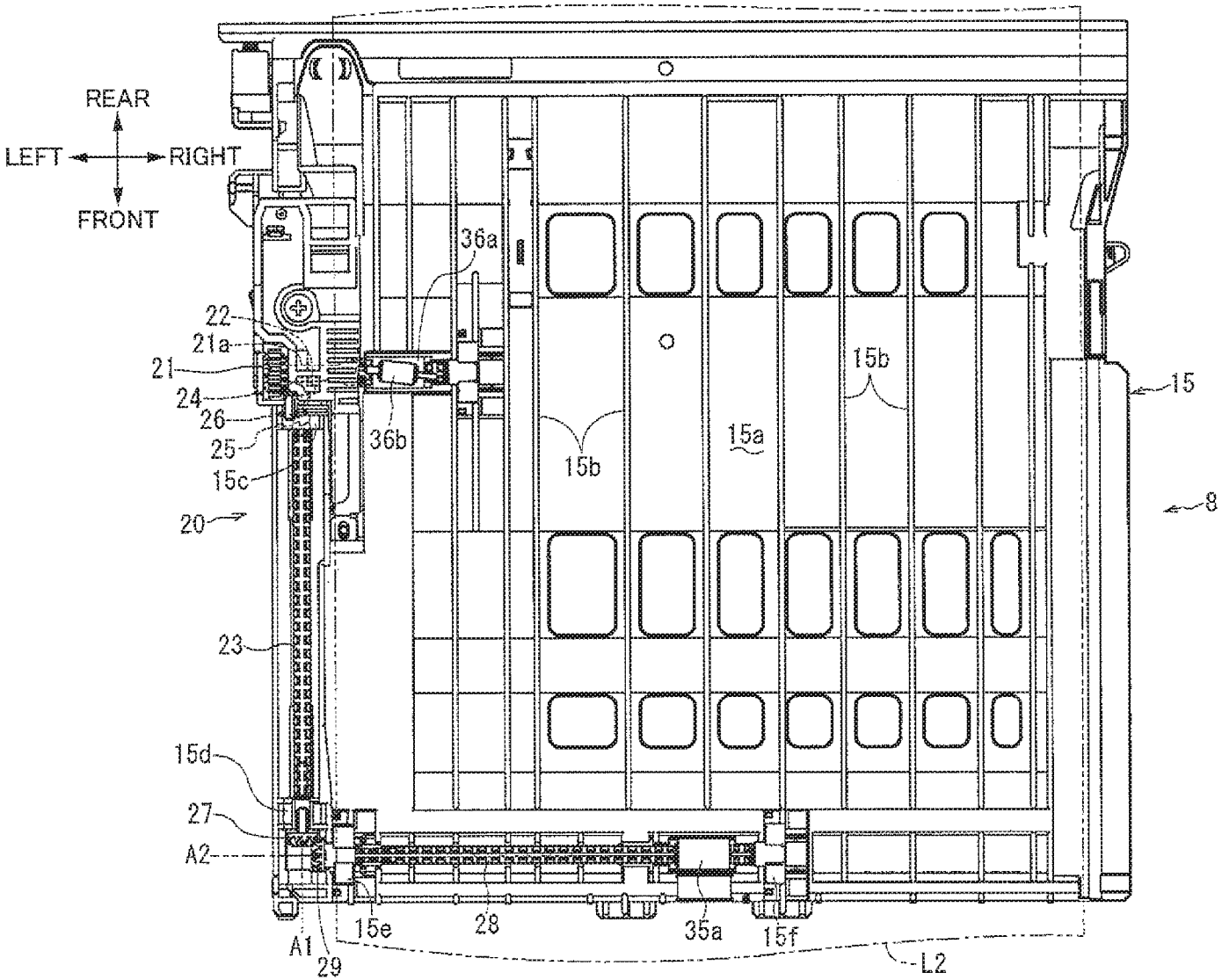
FIG. 3 is a plan view of the re-conveyor.
Figure 4:
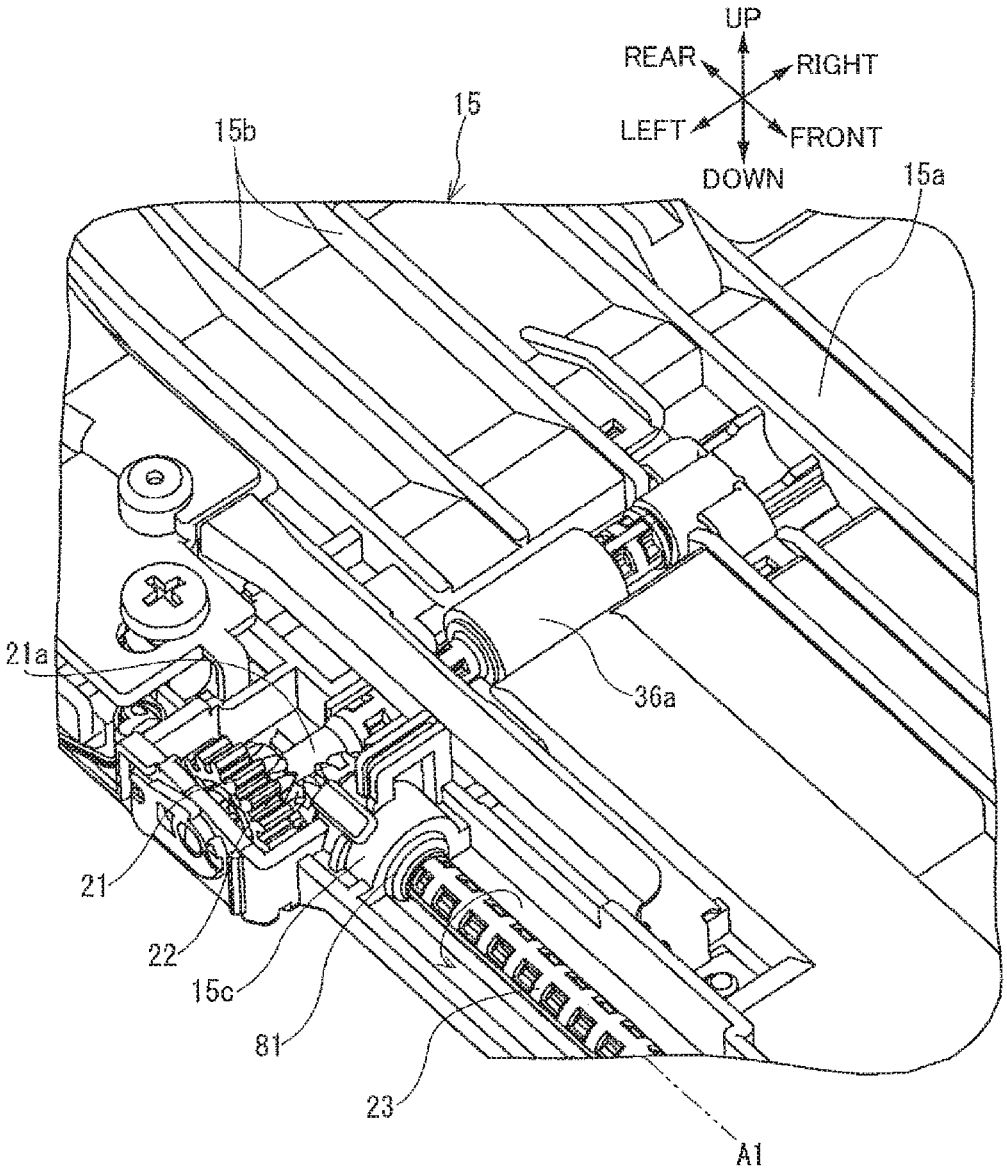
FIG. 4 is an enlarged perspective view of the re-conveyor, illustrating its portion at which a first bevel gear and a second bevel gear are in mesh with each other.
Figure 5:
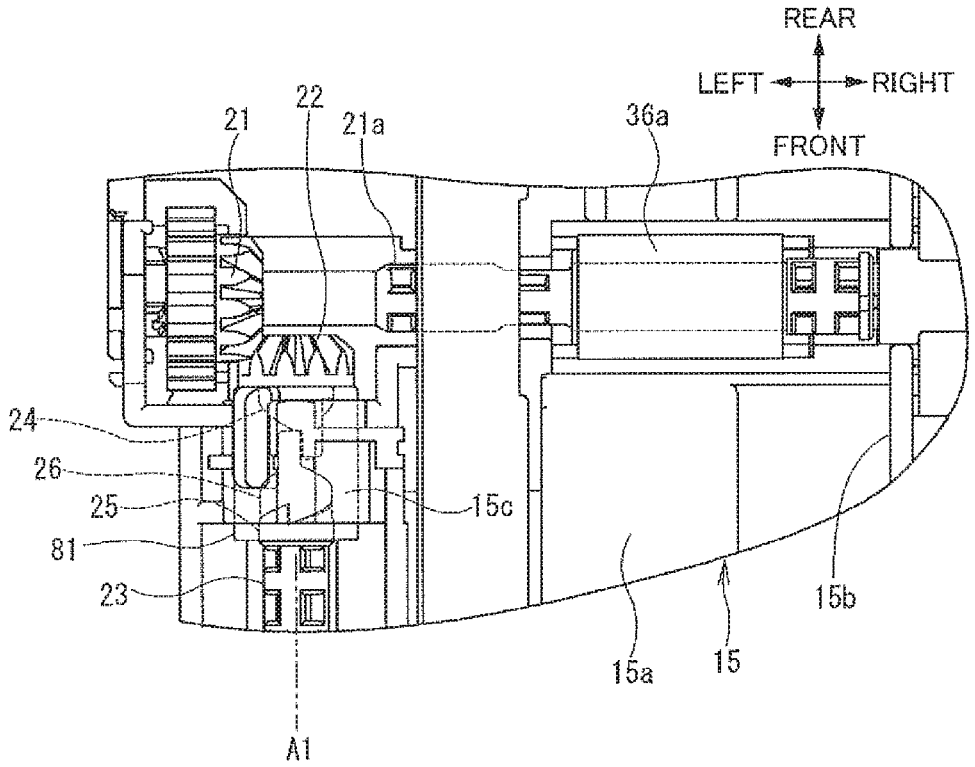
FIG. 5 is an enlarged plan view of the re-conveyor, illustrating its portion at which the first bevel gear and the second bevel gear are in mesh with each other.

As illustrated in FIGS. 3-5, the re-conveyor 8 includes a first bearing 15*c* supporting the covering member 81. The first bearing 15*c* is formed on the chute member 15. The first bearing 15*c* is one example of a bearing. Since the covering member 81 is supported by the first bearing 15*c*, the other-side end portions of the second bevel gear 22, the first engaged member 24, the engaging member 26, the second engaged member 25, and the first shaft member 23 in the axis A1 direction are supported by the chute member 15 rotatably about the axis A1.

In the case where the direction orthogonal to the sheet conveying direction in the re-conveyance path L2 is defined as a widthwise direction, the first bearing 15*c* is disposed outside the area of the re-conveyance path L2 in the widthwise direction. Thus, the first engaged member 24, the second engaged member 25, and the engaging member 26 are disposed outside the area of the re-conveyance path L2 in the widthwise direction. This configuration prevents ingress of foreign matters such as paper dust into spaces between the engaging member 26 and the first engaged member 24, between the first engaged member 24 and the second engaged member 25, and between the engaging member 26 and the second engaged member 25, enabling appropriate transmission of the driving force from the second bevel gear 22 to the first shaft member 23.

The chute member 15 includes a second bearing 15*d* supporting a one-side end portion of the first shaft member 23 in the axis A1 direction such that the first shaft member 23 is rotatable. The chute member 15 includes: a third bearing 15*e* supporting the other-side end portion of the second shaft member 28 in the axis A2 direction such that the second shaft member 28 is rotatable; and a fourth bearing 15*f* supporting the one-side end portion of the second shaft member 28 in the axis A2 direction such that the second shaft member 28 is rotatable.

Effects

In the present embodiment, the image forming apparatus 1 is configured as described above. That is, the image forming apparatus 1 includes the image forming unit 5 and the re-conveyor 8. The re-conveyor 8 has the re-conveyance path L2 through which the sheet S with the image formed on one of its opposite surfaces by the image forming unit 5 is conveyed toward the image forming unit 5 again. The re-conveyor 8 includes the first re-conveying roller 35*a*, the first bevel gear 21, the second bevel gear 22, the first shaft member 23, the first engaged member 24, the second engaged member 25, and the engaging member 26.

The first re-conveying roller 35*a* conveys the sheet S along the re-conveyance path L2. The driving force is transmitted from the motor 4 to the first bevel gear 21. The second bevel gear 22 is engaged with the first bevel gear 21 and rotated about the axis A1. The first shaft member 23 transmits the driving force transmitted from the second bevel gear 22, to the first re-conveying roller 35*a*. The first engaged member 24 is provided on the one-side end of the second bevel gear 22 in the axis A1 direction and rotated together with the second bevel gear 22. The second engaged member 25 is provided on the other-side end of the first shaft member 23 in the axis A1 direction and rotated together with the first shaft member 23. The engaging member 26 is disposed between the first engaged member 24 and the second engaged member 25 and movable in the axis A1 direction between the first position at which the engaging member 26 is engaged only with the first engaged member 24 and the second position at which the engaging member 26 is engaged with the first engaged member 24 and the second engaged member 25.

When the second bevel gear 22 is rotated in the rotational direction by the driving force transmitted from the first bevel gear 21, the engaging member 26 is moved to the second position and engaged with the first engaged member 24 and the second engaged member 25 to rotate the first shaft member 23 in the rotational direction. When the first shaft member 23 is rotated in the rotational direction by the driving force transmitted from the first re-conveying roller 35*a*, the engaging member 26 is moved to the first position, disengaged from the second engaged member 25, and engaged with the first engaged member 24, thereby interrupting the transmission of the driving force from the first shaft member 23 to the second bevel gear 22.

This configuration reduces the load acting on the first re-conveying roller 35*a*, making it possible to reduce the possibility of lowered accuracy of conveyance of the sheet S by the first re-conveying roller 35*a*. It is also possible to appropriately keep the positional relationship between the second bevel gear 22 and the first shaft member 23.

The re-conveyor 8 includes: the third bevel gear 27 provided on the one-side end portion of the first shaft member 23 in the axis A1 direction; and the fourth bevel gear 29 meshed with the third bevel gear 27 and configured to transmit, to the first re-conveying roller 35*a*, the driving force transmitted from the third bevel gear 27. When the driving force is transmitted from the fourth bevel gear 29 to the third bevel gear 27, the thrust force that moves the third bevel gear 27 toward the other side in the axis A1 direction is applied from the fourth bevel gear 29 to the third bevel gear 27. This prevents generation of an excess space between the first shaft member 23 and the second bevel gear 22, making it possible to appropriately keep the positional relationship between the first shaft member 23 and the second bevel gear 22 in the axis A1 direction.

The first engaged member 24 includes: the first inclined portions 24*a* each having the inclined surface which is inclined such that the downstream portion of the inclined surface in the rotational direction of the second bevel gear 22 is located on the other side, in the axis A1 direction, of the upstream portion of the inclined surface in the rotational direction; and the first engaged portions 24*b* each provided at the upstream end portion of the corresponding first inclined portion 24*a* in the rotational direction. The second engaged member 25 includes: the protrusion 25*a* protruding from the other-side end portion of the first shaft member 23 toward the other side in the axis A1 direction; the second inclined portion 25*b* disposed around the protrusion 25*a* and having the inclined surface inclined such that the downstream portion of the inclined surface in the rotational direction is located on the one side, in the axis A1 direction, of the upstream portion of the inclined surface in the rotational direction; and the second engaged portion 25*c* provided at the downstream end portion of the second inclined portion 25*b* in the rotational direction. The engaging member 26 includes: the body portion 26*b* having the fitting hole 26*a* in which the protrusion 25*a* is inserted slidably in the axis A1 direction; the third inclined portion 26*c* formed on the body portion 26*b*, contactable with the second inclined portion 25*b*, and having the inclined surface which is inclined such that the downstream portion of the inclined surface in the rotational direction is located on the one side, in the axis A1 direction, of the upstream portion of the inclined surface in the rotational direction; the engaging portion 26*d* provided at the downstream end portion of the third inclined portion 26*c* in the rotational direction and engageable with the second engaged portion 25*c*; and the first contact portions 26*e* each extending from the body portion 26*b* toward the other side in the axis A1 direction and engageable with the corresponding first engaged portion 24*b* while contacting the corresponding first inclined portion 24*a*. This enables reduction in size of the mechanism for switching between the transmission and the non-transmission of the driving force between the second bevel gear 22 and the first shaft member 23.

The engaging member 26 has the closing portion 26*f* coupled to the first contact portions 26*e* and located at the position overlaying the fitting hole 26*a* when viewed in the axis A1 direction. This configuration prevents the protrusion 25*a* from being inserted into the fitting hole 26*a* from the end portion of the engaging member 26 at which the first contact portions 26*e* is formed, facilitating assembly of the components.

The re-conveyor 8 includes the covering member 81 covering the outer peripheral surfaces of the first engaged member 24, the second engaged member 25, and the engaging member 26. The one-side end portion of the covering member 81 in the axis A1 direction is disposed on the one side of the second inclined portion 25*b* and the second engaged portion 25*c* of the second engaged member 25 in the axis A1 direction. This covering member 81 prevents ingress of foreign matters such as paper dust into the space between the second inclined portion 25*b* of the second engaged member 25 and the third inclined portion 26*c* of the engaging member 26 and the space between the second engaged portion 25*c* of the second engaged member 25 and the engaging portion 26*d* of the engaging member 26. With this configuration, for example, when the engaging member 26 is moved to the second position, engagement of the second engaged portion 25*c* and the engaging portion 26*d* is not hindered, enabling appropriate transmission of the driving force from the second bevel gear 22 to the first shaft member 23.

The covering member 81 includes the brim portion 81*a* provided at the other-side end portion of the covering member 81 in the axis A1 direction and held in contact with the second bevel gear 22. With this configuration, when the second bevel gear 22 is driven by the first bevel gear 21, the thrust force generated on the second bevel gear 22 in the axis A1 direction is received by the brim portion 81*a*, thereby positioning the second bevel gear 22 in the axis A1 direction.

The re-conveyor 8 includes the first bearing 15*c* supporting the covering member 81. In the case where the direction orthogonal to the sheet conveying direction in the re-conveyance path L2 is defined as the widthwise direction, the first bearing 15*c* is disposed outside the area of the re-conveyance path L2 in the widthwise direction. Thus, the first engaged member 24, the second engaged member 25, and the engaging member 26 are disposed outside the area of the re-conveyance path L2 in the widthwise direction. This configuration prevents ingress of foreign matters such as paper dust into spaces between the engaging member 26 and the first engaged member 24, between the first engaged member 24 and the second engaged member 25, and between the engaging member 26 and the second engaged member 25, enabling appropriate transmission of the driving force from the second bevel gear 22 to the first shaft member 23.

The first bevel gear 21 includes the rotation shaft 21*a*. The re-conveyor 8 includes: the second re-conveying roller 36*a* directly connected to the rotation shaft 21*a* of the first bevel gear 21 and configured to convey the sheet S along the re-conveyance path L2; and the second driven roller 36*b* held in close contact with the second re-conveying roller 36*a*. With this configuration, when the first shaft member 23 is rotated in the rotational direction by the driving force transmitted from the first re-conveying roller 35*a*, the transmission of the driving force between the first shaft member 23 and the second bevel gear 22 is interrupted. Thus, the heavy load acting on the first bevel gear 21 does not act on the first re-conveying roller. This reduces a large amount of the load acting on the first re-conveying roller 35*a*, making it possible to reduce the possibility of lowered accuracy of conveyance of the sheet S by the first re-conveying roller 35*a*.

What is claimed is:

1. An image forming apparatus, comprising:

an image forming unit configured to form an image on a sheet; and a re-conveyor configured to re-convey the sheet on which an image is formed toward the image forming unit in a re-conveying direction, wherein the re-conveyor comprises:

a first bevel gear configured to receive a driving force transmitted from a drive source;

a second bevel gear engaged with the first bevel gear and configured to be rotated about an axis extending in a first direction;

a first re-conveying roller configured to convey the sheet in the re-conveying direction;

a shaft member configured to transmit the driving force transmitted from the second bevel gear, to the first re-conveying roller;

a first engaged member provided at one end of the second bevel gear in the first direction, which one end is nearer to the shaft member than the other end of the second bevel gear in the first direction, the first engaged member being configured to be rotated together with the second bevel gear;

a second engaged member provided at the other end of the shaft member in the first direction, which other end is nearer to the second bevel gear than one end of the shaft member in the first direction, the second engaged member being configured to be rotated together with the shaft member; and an engaging member disposed between the first engaged member and the second engaged member and movable between a first position at which the engaging member is engaged only with the first engaged member and a second position at which the engaging member is engaged with the first engaged member and the second engaged member, and wherein the engaging member is configured to:

when the second bevel gear is rotated in a rotational direction by the driving force transmitted from the first bevel gear, be moved to the second position and engaged with the first engaged member and the second engaged member to rotate the shaft member in the rotational direction; and when the shaft member is rotated in the rotational direction by the driving force transmitted from the first re-conveying roller, be moved to the first position, disengaged from the second engaged member, and engaged with the first engaged member to interrupt transmission of the driving force from the shaft member to the second bevel gear.

2. The image forming apparatus according to claim 1, wherein the re-conveyor comprises:

a third bevel gear provided at the one end of the shaft member in the first direction; and a fourth bevel gear engaged with the third bevel gear and configured to transmit the driving force transmitted from the third bevel gear, to the first re-conveying roller.

3. The image forming apparatus according to claim 1, wherein the first engaged member comprises:

a first inclined portion comprising an inclined surface inclined such that an upstream portion of the inclined surface in the rotational direction is located on a first side, in the first direction, of a downstream portion of the inclined surface in the rotational direction; and a first engaged portion provided at an upstream end portion of the first inclined portion in the rotational direction, wherein the second engaged member comprises:

a protrusion protruding toward a second side from the other end of the shaft member in the first direction;

a second inclined portion disposed around the protrusion and comprising an inclined surface inclined such that a downstream portion of the inclined surface of the second inclined portion in the rotational direction is located on the first side, in the first direction, of an upstream portion of the inclined surface of the second inclined portion in the rotational direction; and a second engaged portion provided at a downstream end portion of the second inclined portion in the rotational direction, and wherein the engaging member comprises:

a body portion comprising a fitting hole in which the protrusion is inserted slidably in the first direction;

a third inclined portion formed at the body portion, being contactable with the second inclined portion, and comprising an inclined surface inclined such that a downstream portion of the inclined surface of the third inclined portion in the rotational direction is located on the first side, in the first direction, of an upstream portion of the inclined surface of the third inclined portion in the rotational direction;

an engaging portion engageable with the second engaged portion and provided at a downstream end portion of the third inclined portion in the rotational direction; and a first contact portion extending toward the second side in the first direction from the body portion and engageable with the first engaged portion while contacting the first inclined portion.

4. The image forming apparatus according to claim 3, wherein the engaging member comprises a closing portion coupled to the first contact portion and disposed at a position at least partly overlapping the fitting hole when viewed in the first direction.

5. The image forming apparatus according to claim 3, wherein the re-conveyor comprises a covering member covering outer peripheral surfaces of the first engaged member, the second engaged member, and the engaging member, and wherein one end portion of the covering member in the first direction is disposed on the first side of the second inclined portion and the second engaged portion in the first direction.

6. The image forming apparatus according to claim 5, wherein the covering member comprises a second contact portion at the other end portion of the covering member in the first direction, and the second contact portion is in contact with the second bevel gear.

7. The image forming apparatus according to claim 5, wherein the re-conveyor comprises a bearing configured to support the covering member, and wherein, in a case where a direction orthogonal to a sheet conveying direction in a sheet conveyance path is defined as a widthwise direction, the bearing is disposed outside an area of the sheet conveyance path in the widthwise direction.

8. The image forming apparatus according to claim 1, wherein the first bevel gear comprises a rotation shaft, and wherein the re-conveyor comprises:

a second re-conveying roller directly connected to the rotation shaft of the first bevel gear and configured to convey the sheet in the re-conveying direction; and a driven roller being in close contact with the second re-conveying roller.

9. The image forming apparatus according to claim 1, wherein the shaft member is disposed such that an axis of the shaft member coincides with the axis of the second bevel gear.

10. An image forming apparatus, comprising:

an image forming unit configured to form an image on a sheet; and a re-conveyor configured to re-convey the sheet on which an image is formed toward the image forming unit in a re-conveying direction, wherein the re-conveyor comprises:

a first bevel gear configured to receive a driving force transmitted from a drive source;

a second bevel gear engaged with the first bevel gear and configured to be rotated about an axis extending in a first direction;

a first re-conveying roller configured to convey the sheet in the re-conveying direction;

a shaft member that is a portion of a transmission mechanism configured to transmit the driving force from the second bevel gear to the first re-conveying roller;

a first engaged member provided at one of opposite end portions of the second bevel gear, which one is nearer to the shaft member in the first direction than the other, and the first engaged member is configured to be rotated about the axis together with the second bevel gear;

a second engaged member provided at one of opposite end portions of the shaft member, which one is nearer to the second bevel gear in the first direction than the other, the second engaged member being configured to be rotated about the axis together with the shaft member; and an engaging member disposed between the first engaged member and the second engaged member and comprising a first engaging portion and a second engaging portion, the first engaging portion being an end portion of the engaging member which is nearer to the first engaged member in the first direction than the second engaging portion, the second engaging portion being an end portion of the engaging member which is nearer to the second engaged portion in the first direction than the first engaging portion, the engaging member being movable in the first direction between a first position at which the first engaging portion is engaged with the first engaged member, and the second engaging portion is not engaged with the second engaged portion and a second position at which the first engaging portion is engaged with the first engaged member, and the second engaging portion is engaged with the second engaged member, wherein at least one of the first engaged member and the engaging member comprises a first converting inclined portion configured to convert rotational power of the first engaged member about the axis, to a force that is applied from the first engaged member to the engaging member and that is directed from the first position toward the second position, and wherein at least one of the second engaged member and the engaging member comprises a second converting inclined portion configured to convert rotational power of the second engaged member about the axis, to a force that is applied from the second engaged portion to the engaging member and that is directed from the second position toward the first position.

* * * * *